US012479631B2

(12) United States Patent
Chang

(10) Patent No.: US 12,479,631 B2
(45) Date of Patent: Nov. 25, 2025

(54) TAMPER EVIDENT CONTAINER

(71) Applicant: EASYPACK ENTERPRISE CO., LTD., Taichung (TW)

(72) Inventor: Shuen Chi Chang, Taichung (TW)

(73) Assignee: EASYPACK ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 18/886,852

(22) Filed: Sep. 16, 2024

(65) Prior Publication Data

US 2025/0313383 A1 Oct. 9, 2025

(30) Foreign Application Priority Data

Apr. 9, 2024 (TW) ..... 113113124

(51) Int. Cl.
*B65D 43/02* (2006.01)

(52) U.S. Cl.
CPC ..... *B65D 43/0245* (2013.01); *B65D 2543/00203* (2013.01); *B65D 2543/00453* (2013.01); *B65D 2543/00527* (2013.01); *B65D 2543/00537* (2013.01); *B65D 2543/00657* (2013.01); *B65D 2543/00685* (2013.01); *B65D 2543/00768* (2013.01); *B65D 2543/00796* (2013.01); *B65D 2543/00842* (2013.01)

(58) Field of Classification Search
CPC ..... B65D 43/0245; B65D 43/0239; B65D 2543/00453; B65D 17/404
USPC ..... 220/269, 270
See application file for complete search history.

(56) References Cited

U.S. PATENT DOCUMENTS

| | | | | |
|---|---|---|---|---|
| 11,780,654 | B2 * | 10/2023 | Farach | B65D 21/0219 206/508 |
| 2005/0184070 | A1 * | 8/2005 | Boback | B65D 43/021 220/270 |
| 2016/0355303 | A1 * | 12/2016 | Kalmanides | B65D 43/0241 |
| 2017/0001766 | A1 * | 1/2017 | Cimmerer | B65D 17/404 |
| 2018/0118420 | A1 * | 5/2018 | Allers | B65D 43/0235 |
| 2020/0346825 | A1 | 11/2020 | Liu | |
| 2022/0250808 | A1 | 8/2022 | Hsieh | |

FOREIGN PATENT DOCUMENTS

| | | | |
|---|---|---|---|
| CN | 113086404 | A | 7/2021 |
| TW | M598288 | U | 7/2020 |

* cited by examiner

*Primary Examiner* — Jeffrey R Allen
(74) *Attorney, Agent, or Firm* — Sinorica International Patent & Trademark

(57) ABSTRACT

A tamper evident container includes a box and a lid. The box has a bottom, an annular wall projected from bottom, and a box flange projected from the annular wall. A first tab is connected to the box flange. The lid has a cover piece and a lid flange. A second tab is connected to the lid flange. The second tab has a root section, a neck section and a head section in sequence, wherein a width of the second tab is gradually decreased from the root section to the neck section, and then is gradually increased from the neck section to the head section. The second tab has a portion connected to the first section, on which a weaken line is provided.

8 Claims, 6 Drawing Sheets

TAMPER EVIDENT CONTAINER

BACKGROUND OF THE INVENTION

The present invention relates to a container, and more particularly to a tamper evident container.

In the present market, there are various plastic containers to receiving specified goods, such foods, fruits, sushi, 3C products and so on. In order to prevent the goods received in the container from being changed or removed before they are sold, the containers are provided with security measures, such as a band fastened on the container, for consumers to identify the containers had been opened or not.

However, such containers are expensive than that without security measures. For the reason of cost down, many plastic containers with low-cost security measures are provided in the market. However, there are some drawbacks in the containers with security measures, such as not easy to open and easy to break down the security measures.

SUMMARY OF THE INVENTION

In view of the above, the primary objective of the present invention is to provide a tamper evident container, which is capable of identifying the container being unauthorized opened and keeping an easy way to open the container.

In order to achieve the objective of the present invention, a tamper evident container includes a box, a first tab, a lid and a second tab. The box has a bottom and an annular wall. The annular wall is connected to an edge of the bottom to form a storage room with an opening at a top thereof. The annular wall has a box flange substantially perpendicular to the annular wall. The first tab is connected to the box flange of the box. The lid, which has a shape complementary to the opening of the box, has a cover piece and a lid flange connected to the cover piece. The second tab is connected to the lid flange of the lid. The second tab has a root section, a neck section and a head section while the root section is connected to the lid flange of the lid and the neck section is between the root section and the head section. A width of the second tab gradually decreases from the root section to the neck section and then gradually increases from the neck section to the head section. The second tab has a portion connected to the first tab, on which a weaken line is formed. The second tab is bent along the weaken line to have the second tab stacked on the first tab, the cover piece closing the opening of the box and the lid flange attaching to the box flange when the lid engages the box.

In an embodiment, the annular wall of the box is provided with a recess on an inner side adjacent to the opening, and the cover piece of the lid is provided with a protrusion. The protrusion is received in the recess when the lid engages the box.

In an embodiment, the box has several blocks on a bottom side of the recess and the lid has several slots on the blocks. The blocks engage the slots respectively when the lid engages the box.

In an embodiment, the box has a stop wall projected from the box flange, and the lid flange is located behind the stop wall when the lid engages the box.

In an embodiment, the stop wall has a gap associated with the first tab. The root section of the second tab passes through the gap when the lid engages the box. The width of the second tap at a portion where the root section connects the lid flange is greater than a width of the gap.

In an embodiment, the box flange of the box is higher than second tab, so that the second tab is kept a distance from the first tab when the lid engages the box.

In an embodiment, the head section of the second tab has a curved edge and two lateral edges connected to opposite ends of the curved edge respectively, and the weaken line is formed on one of the lateral edges.

In an embodiment, the box is provided with a plurality of first connectors on an inner side of the annular wall, and the lid is provided with a plurality of second connectors. The first connectors engage the second connectors respectively when the lid engages the box.

A preferred embodiment is described hereafter, accompanied with drawings, according to the objective and function of the present invention.

DETAILED DESCRIPTION OF THE INVENTION

Figure 1:
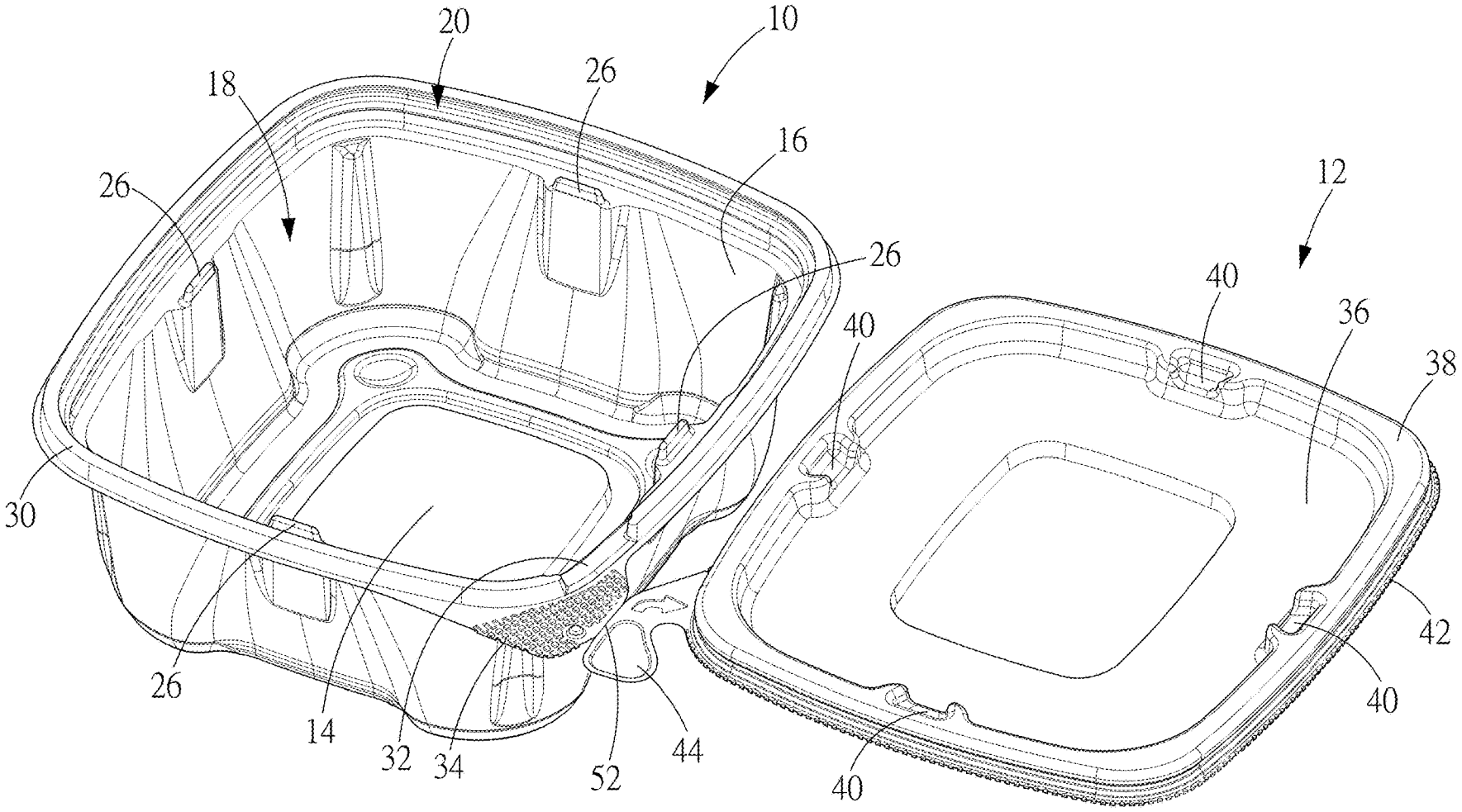
FIG. 1 is a perspective view of a preferred embodiment of the present invention, showing the container opened.

As shown in FIGS. 1 to 6, a tamper evident container of the preferred embodiment of the present invention includes a box 10 and a lid 12.

The box 10 is rectangular, having a bottom 14 and an annular wall 16. The annular wall 16 has an end connected to an edge of the bottom 14 to form a storage room 18 with an opening at a top (opposite to the bottom 14). The annular wall 16 is provided with an annular recess 20 on an inner side and adjacent to the opening. The recess 20 has a bottom side 22 and a lateral side 24, wherein the bottom side 22 is substantially perpendicular to the annular wall 16 while the lateral side 24 is substantially perpendicular to the bottom side 22. Four first connectors 26 are provided on the bottom side 22. In the present embodiment, the first connectors are blocks on the bottom side 22. The annular wall 16 further has a box flange 28 connected to the lateral side 24 and substantially perpendicular to the lateral side 24. A stop wall 30 is projected from the box flange 28. The stop wall 30 has a gap 32 at a corner of the box 10.

The box 10 is provided with a first tab 34 connected to the box flange 28 and associated with the gap 32. The first tab 34 is a segment extended outwardly from the box flange 28, which has texture to increase friction for user to hold it.

The lid 12 has a shape associated with the opening of the box 10, which has a cover piece 36 and a protrusion 38 on an inner side of the cover piece 36. The protrusion 38 is complementary to the recess 20 of the box 10, and is provided with four second connectors 40 to engage the first connectors 26. In the present embodiment, the second connectors 40 are slots on a top of the protrusion 38. The lid 12 further has a lid flange 42 connected to an outer side of the protrusion 38.

Figure 4:
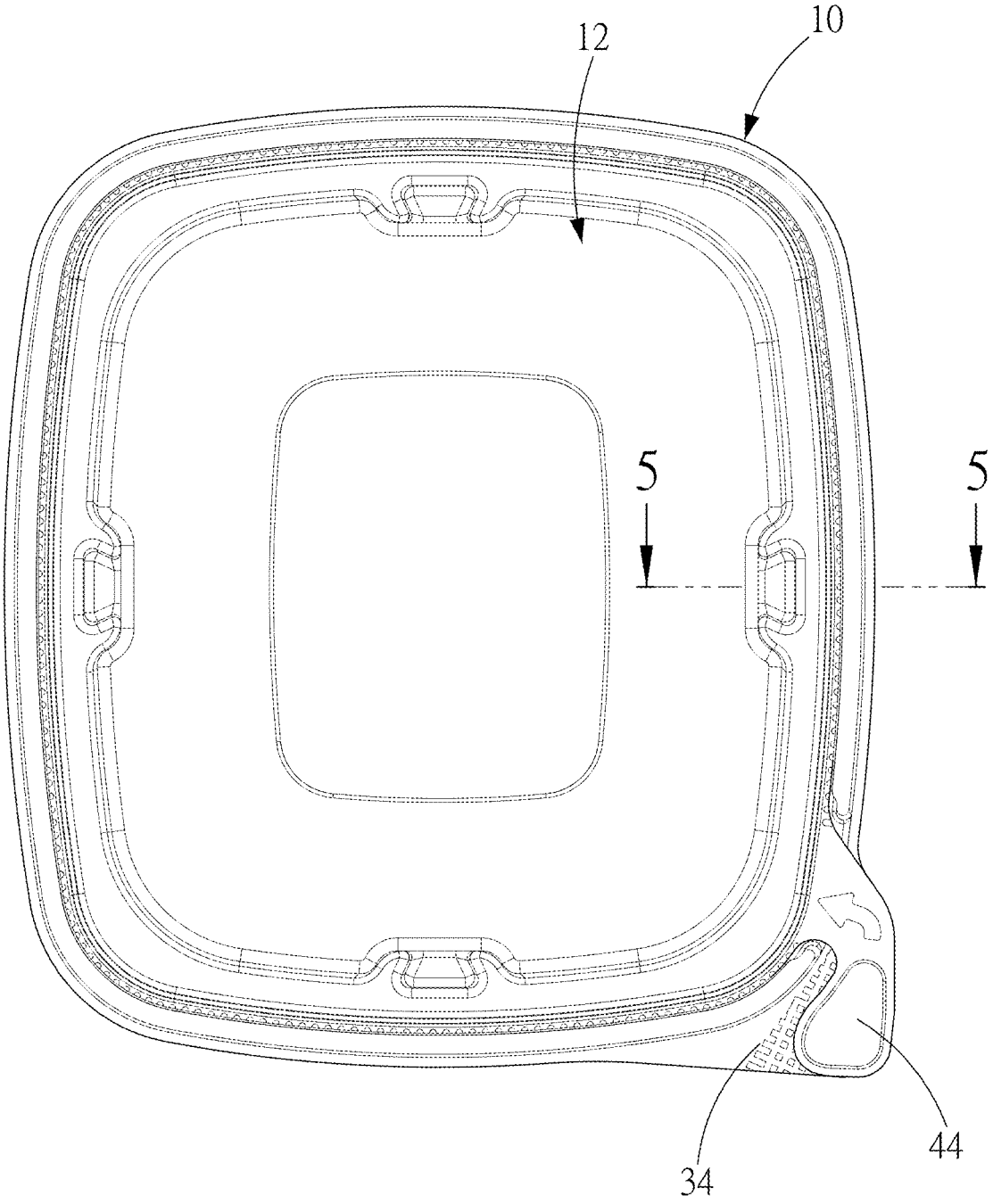
FIG. 4 is a top view of the preferred embodiment of the present invention.

As shown in FIG. 4, the lid 12 has a second tab 44 connected to the lid flange 42. The second tab 44 has a root section 46, a neck section 48 and a head section 50 in sequence, wherein the root section 46 is connected to the lid flange 42, and the neck section 48 is between the root section 46 and the head section 50. A width of the second tab 44 gradually decreases from the root section 46 to the neck section 48, and then gradually increases from the neck section 48 to the head section 50. In an initial condition, the head section 50 has a portion connected to the first tab 34 of the box 10, and a weaken line 52 is provided with the first and the second tabs 34, 44. The weaken line 52 has several separative perforations, so that the weaken line 52 is easy to be broken when a user exerts the first and the second tabs 34, 44 in opposite directions to separate them. The head section looks like an egg in a top view, having a curved edge 54 and two lateral edges 56 connected to opposite ends of the curved edge 54. The weaken line 52 is provided on one of the lateral edges 56.

Figure 2:
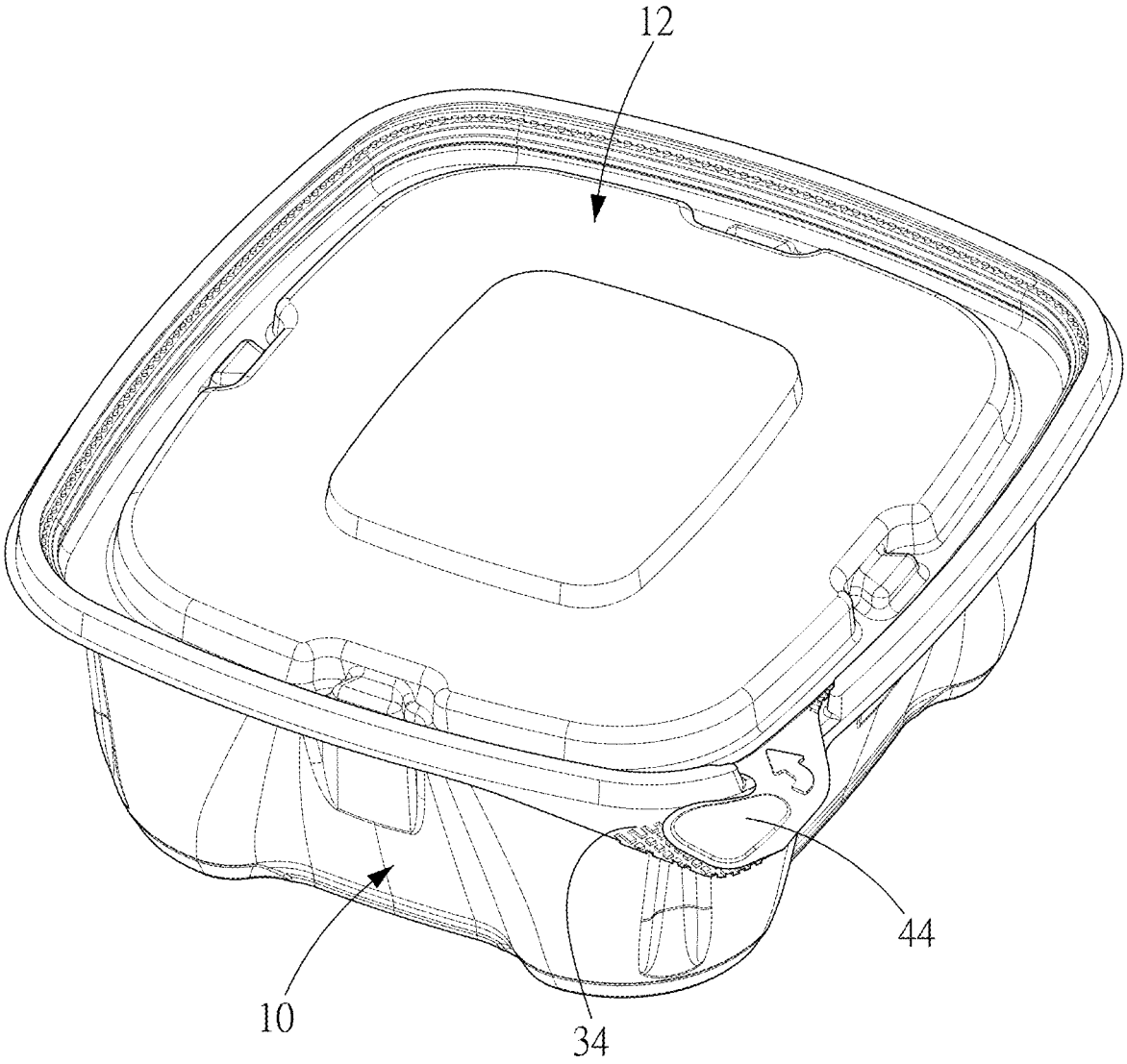
FIG. 2 is a perspective view of the preferred embodiment of the present invention, showing the container closed.
Figure 3:
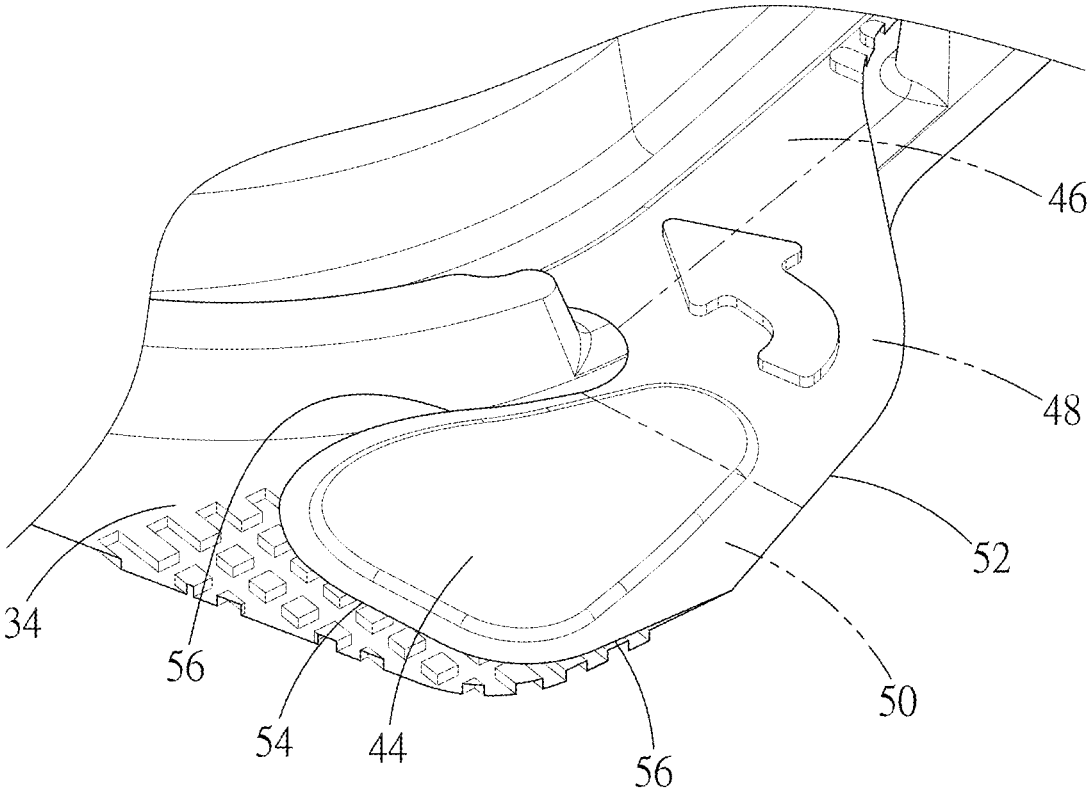
FIG. 3 is a partial enlarged view of FIG. 2.
Figure 5:
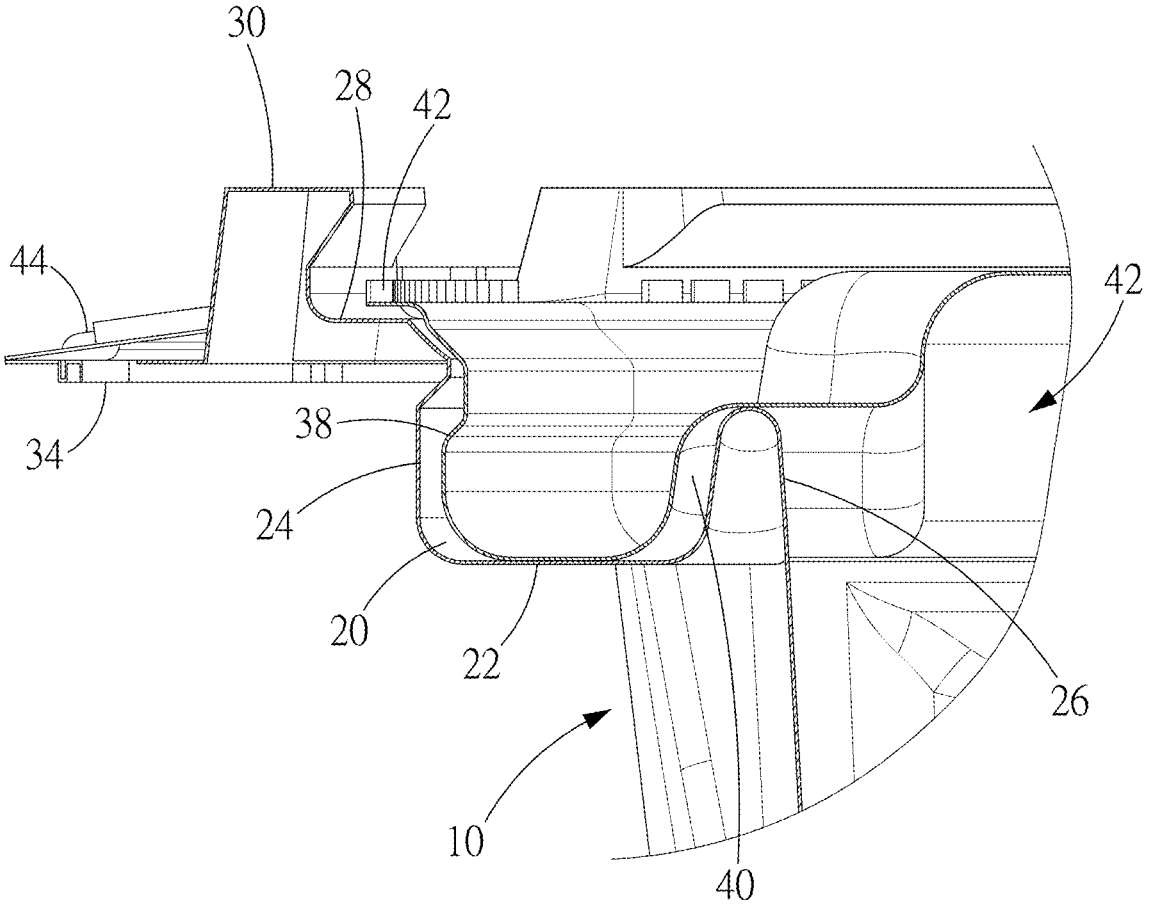
FIG. 5 is a sectional view along the 5-5 line in FIG. 4.
Figure 6:
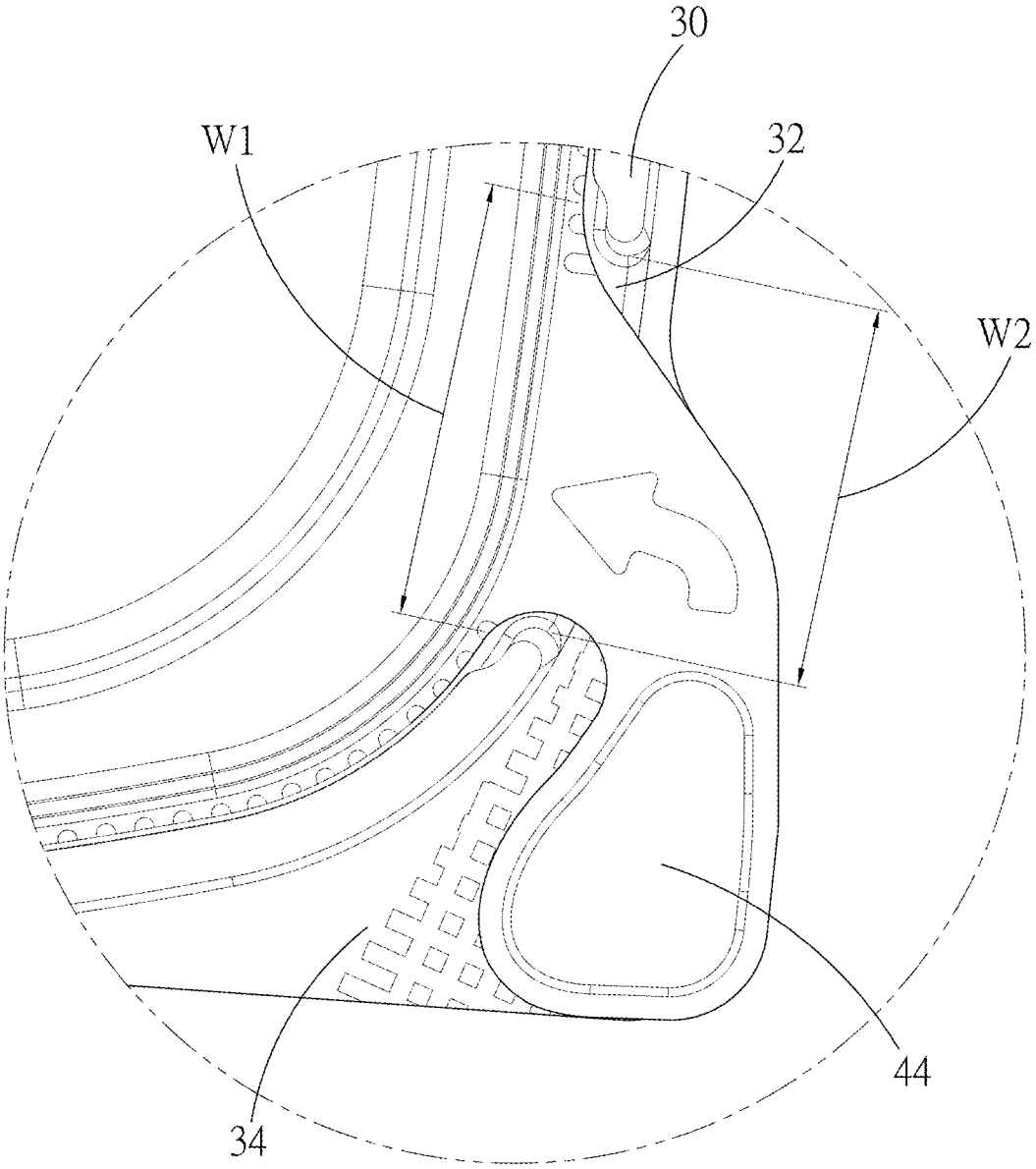
FIG. 6 is a partial enlarged view of FIG. 4.

As shown in FIGS. 2 and 3, the second tab 44 is bent along the weaken line 52 and stacked on the first tab 34 when the lid 12 engages the box 10. The entire second tab 44 is overlapped with the first tab 34. The root section 46 of the second tab 44 passes through the gap 32 of the box 10 and attaches to the box flange 28. The width W1 of the second tab 44 at a portion where the root section 46 is connected to the lid 12 is greater than a width W2 of the gap 32. As shown in FIG. 5, the lid flange 42 is behind the stop wall 30 and attaches to the box flange 28. The protrusion 38 of the lid 12 is received in the recess 20 of the box 10 to have the first and the second connectors 26, 40 engaged. As shown in FIG. 5, since the lid flange 42 is higher than the first tab 34 when the lid 12 is coved on the box 10, the second tab 44 is kept a distance from the first tab 34, except the portion of the second tab 44 connected to the first tab 34 that helps user to hold the first and the second tab 34, 44 respectively by fingers.

To open the container, user has to hold the first and the second tab 34, 44 and exerts them in opposite direction to break the weak line 52, then continuously pulls the second tab 44 upwardly to disengage the first and the second connectors 26, 40 until the lid 12 is removed from the box 10.

As the description above, the entire lid 12 is located behind the stop wall 30 of the box 30, so that it is almost impossible to open the container in a way other than the procedure as described above, so that user may observe the weaken line 52 to identify that the container had been opened or not.

It must be pointed out that the embodiments described above are only some preferred embodiments of the present invention. All equivalent structures which employ the concepts disclosed in this specification and the appended claims should fall within the scope of the present invention.

The invention claimed is:

1. A tamper evident container, comprising:

a box having a bottom and an annular wall; the annular wall connected to an edge of the bottom to form a storage room with an opening at a top thereof; the annular wall has a box flange substantially perpendicular to the annular wall;

a first tab connected to the box flange of the box;

a lid, which has a shape complementary to the opening of the box, having a cover piece and a lid flange connected to the cover piece; and a second tab connected to the lid flange of the lid;

wherein the second tab has a root section, a neck section and a head section while the root section is connected to the lid flange of the lid and the neck section is between the root section and the head section; a width of the second tab gradually decreases from the root section to the neck section and then gradually increases from the neck section to the head section; the second tab has a portion connected to the first tab and a weaken line is formed therebetween;

wherein the second tab is bent along the weaken line to have the second tab stacked on the first tab, the cover piece closing the opening of the box and the lid flange attaching to the box flange when the lid engages the box.

2. The tamper evident container of claim 1, wherein the annular wall of the box is provided with a recess on an inner side adjacent to the opening, and the cover piece of the lid is provided with a protrusion; the protrusion is received in the recess when the lid engages the box.

3. The tamper evident container of claim 2, wherein the box has several blocks on a bottom side of the recess and the lid has several slots on the protrusion; the blocks engage the slots respectively when the lid engages the box.

4. The tamper evident container of claim 1, wherein the box has a stop wall projected from the box flange, and the lid flange is located behind the stop wall when the lid engages the box.

5. The tamper evident container of claim 4, wherein the stop wall has a gap associated with the first tab; the root section of the second tab passes through the gap when the lid engages the box; the width of the second tap at a portion where the root section connects the lid flange is greater than a width of the gap.

6. The tamper evident container of claim 1, wherein the box flange of the box is higher than the second tab, so that the second tab is kept a distance from the first tab when the lid engages the box.

7. The tamper evident container of claim 1, wherein the head section of the second tab has a curved edge and two lateral edges connected to opposite ends of the curved edge respectively, and the weaken line is formed on one of the lateral edges.

8. The tamper evident container of claim 1, wherein the box is provided with a plurality of first connectors on an inner side of the annular wall, and the lid is provided with a plurality of second connectors; the first connectors engage the second connectors respectively when the lid engages the box.

* * * * *